US006092791A

United States Patent [19]

Kingery

[11] Patent Number: 6,092,791

[45] Date of Patent: Jul. 25, 2000

[54] RATCHET WITH JOURNALED SPOOL

[76] Inventor: Gerald M. Kingery, 1038 N. Wade Dr., Gilbert, Ariz. 85234

[21] Appl. No.: 08/978,766

[22] Filed: Nov. 26, 1997

Related U.S. Application Data

[63] Continuation-in-part of application No. 08/947,088, Oct. 8, 1997, which is a continuation of application No. 08/813,863, Mar. 7, 1997, abandoned, which is a continuation of application No. 08/595,754, Feb. 2, 1996, abandoned, which is a continuation of application No. 08/232,491, Apr. 25, 1994, abandoned.

[51] Int. Cl.[7] ..... B66D 1/30

[52] U.S. Cl. ..... 254/371; 254/391; 254/411; 254/902

[58] Field of Search ..... 254/371, 390, 254/391, 409, 411, 403, 902

[56] References Cited

U.S. PATENT DOCUMENTS

| | | | |
|---|---|---|---|
| 492,550 | 2/1893 | Ferrall . | |
| 649,634 | 5/1900 | Fischer . | |
| 1,111,118 | 9/1914 | Williamson . | |
| 1,372,900 | 3/1921 | Olinger . | |
| 1,535,791 | 4/1925 | Raeburn . | |
| 1,545,482 | 7/1925 | Burrmann | 254/390 |
| 2,194,679 | 3/1940 | Suter | 188/65.1 |
| 2,553,630 | 5/1951 | Capetta | 188/82.7 |
| 2,802,366 | 8/1957 | Borner | 74/230.3 |
| 2,875,981 | 3/1959 | Hunter | 254/391 X |
| 2,922,310 | 1/1960 | Anderson | 74/230.3 |
| 3,255,997 | 6/1966 | Ferdig | 254/192 |
| 3,516,642 | 6/1970 | Pomagalski et al. | 254/167 |
| 3,524,626 | 8/1970 | Pomagalski et al. | 254/167 |
| 3,622,689 | 11/1971 | Sparks | 254/168 |
| 3,714,838 | 2/1973 | Gilson | 74/230.24 |
| 3,822,310 | 7/1974 | Anderson | 254/390 X |
| 4,151,980 | 5/1979 | Burton et al. | 254/371 |
| 4,580,766 | 4/1986 | Woodgate | 254/371 |
| 4,603,839 | 8/1986 | Ekman et al. | 254/329 |
| 4,640,496 | 2/1987 | Van Hoomissen et al. | 254/415 |
| 4,917,361 | 4/1990 | Maxcy | 254/390 X |
| 5,332,195 | 7/1994 | Sugiyama | 254/371 |
| 5,368,281 | 11/1994 | Skyba | 254/193 |
| 5,722,640 | 3/1998 | Skyba | 254/371 X |

FOREIGN PATENT DOCUMENTS

| | | | |
|---|---|---|---|
| 96429 | 12/1983 | European Pat. Off. . | |
| 615802 | 1/1927 | France | 254/391 |
| 627023 | 9/1927 | France . | |
| 2757033 | 6/1979 | Germany | 254/390 |
| 682553 | 11/1952 | United Kingdom . | |

OTHER PUBLICATIONS

"Rope Ratchet" instructional sheet with artist's depictions of use of the ratchet, Carolina North Manufacturing Inc.

*Primary Examiner*—Donald P. Walsh
*Assistant Examiner*—Emmanuel M. Marcelo
*Attorney, Agent, or Firm*—Cahill, Sutton & Thomas P.L.C.

[57] ABSTRACT

A ratchet for use with a cord includes a pair of opposed tear drop shaped members defining a one piece housing for rotatably supporting a one piece ratchet spool, for supporting a pivotally mounted thumb release and for supporting an angularly displacable hook. Opposed circular cavities are disposed within the members to rotatably support corresponding bosses extending from opposed sides of the spool. A plurality of opposed interleaved non-radial ribs extend from opposed surfaces of the spool to frictionally grip a cord partially extending about the spool. A pair of wheels forming the spool are interlocked with and secured to one another through a key and keyway.

18 Claims, 4 Drawing Sheets

RATCHET WITH JOURNALED SPOOL

CROSS-REFERENCE TO RELATED APPLICATIONS

The present invention is a continuation-in-part application of a patent application entitled "UNITARY, RIDGED AND RATCHETED PULLEY BLOCK", by GERALD M. KINGERY, assigned Ser. No. 08/947,088, filed Oct. 8, 1997; which is a continuation of a patent application entitled "UNITARY, RIDGED AND RATCHETED PULLEY BLOCK", assigned Ser. No. 08/81.3,863, filed Mar. 7, 1997, now abadoned; which is a continuation of a patent application entitled "UNITARY, RIDGED AND RATCHETED PULLEY BLOCK", assigned Ser. No. 08/595,754, filed Feb. 2, 1996, now abandoned; which is a continuation of patent application entitled "RATCHET", assigned Ser. No. 08/232,491, filed Apr. 25, 1994, now abandoned, all of which applications describe inventions by the present inventor.

BACKGROUND OF THE INVENTION

1. Field of the Invention

The present invention relates to ratchets and, more particularly, to a ratchet for use with a cord and having a small parts count.

2. Description of Related Art

Ratchets, used with cords such as rope, metallic cables and the like, include a spool about which the cord is partially wrapped. Circumferentially located teeth positionally fixed with the spool cooperate with a pawl to permit rotation of the spool in one direction to tighten the cord and to prevent rotation in the other direction to bring about gripping of the cord by the spool when a force is applied to the cord. The pawl usually includes a thumb release to permit selective rotation of the spool in either direction. A hook or other securing member extends from the ratchet to permit anchoring of the ratchet. Known ratchets include many parts for the ratcheting function, the supporting shaft for the spool, the thumb release and the hook. Such large parts count increases the time and costs attendant manufacture and assembly. Unless each of the various parts are formed of non-corroding elements, corrosion in harsh environments, such as sea water, will significantly shorten the useful operating life of the ratchet. The operating surfaces of the cord engaging spool usually abrade and destructively compress the cord resulting in reduced tensile strength and possible catastrophic failure of the cord after a short period of use. The shaft supporting the spool is generally of relatively small diameter which imposes significant forces per unit area of the supporting housing and results in a likelihood of catastrophic failure.

SUMMARY OF THE INVENTION

A pair of opposed members having studs extending therebetween from one member into engagement with cavities in the other member are sonically welded or otherwise permanently secured in place to form the housing of a ratchet. A spool includes a pair of wheels mechanically secured to one another with a key and a keyway and the junction therebetween is sonically welded or otherwise permanently formed. The spool further includes circular bosses disposed on opposed sides to serve in the manner of journals. Circular cavities within the pair of opposed members of the housing receive the bosses to rotatably support the spool within the housing. A pin is mounted within opposed corresponding cavities in the pair of opposed members to rotatably support a thumb release having a pawl cooperating with teeth formed on one side of the spool. A rod extending from one member of the opposed pair of members and welded into a cavity in the other member supports a hook for suspending the ratchet. A plurality of non-radially aligned ribs are formed on the surface of each wheel in opposed relationship to one another. The opposed ribs of the two wheels are in interleaved relationship with one another to mechanically grip a cord therebetween by forcing it into a serpentine like configuration upon application of a pulling force upon one of the cord lengths extending from the ratchet when rotation of the spool is prevented by interference of the pawl with the teeth. By applying a pulling force upon the other cord length, rotation of the spool is accommodated by the pawl. By molding the parts of the ratchet from high strength plastic that can be formed into the desired shape and by using stainless steel or other non-corroding material for the thumb release supporting pin, thumb release spring and the hook, deterioration of the ratchet due to corrosion will be prevented.

It is therefore the primary object of the present invention to provide a non-corroding ratchet having a low parts count.

Another object of the present invention is to provide a low parts count ratchet to reduce manufacturing and assembly costs.

Yet another object of the present invention is to provide a ratchet usable in harsh environments without fear of deterioration.

Still another object of the present invention is to provide a ratchet having mold formed primarily plastic elements.

A further object of the present invention is to provide a ratchet assemblable by sonic welding.

A yet further object of the present invention is to provide a spool for a ratchet, which spool has large diameter opposed supporting journals to reduce the load density of forces imposed.

A still further object of the present invention is to provide a spool for a ratchet having a pair of wheels mechanically aligned with one another and welded to one another to ensure their positional relationship.

A still further object of the present invention is to provide a spool for a ratchet having a pair of wheels interconnected by a key and a keyway to prevent relative rotation therebetween, which key and keyway are integrally formed with the respective wheels.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
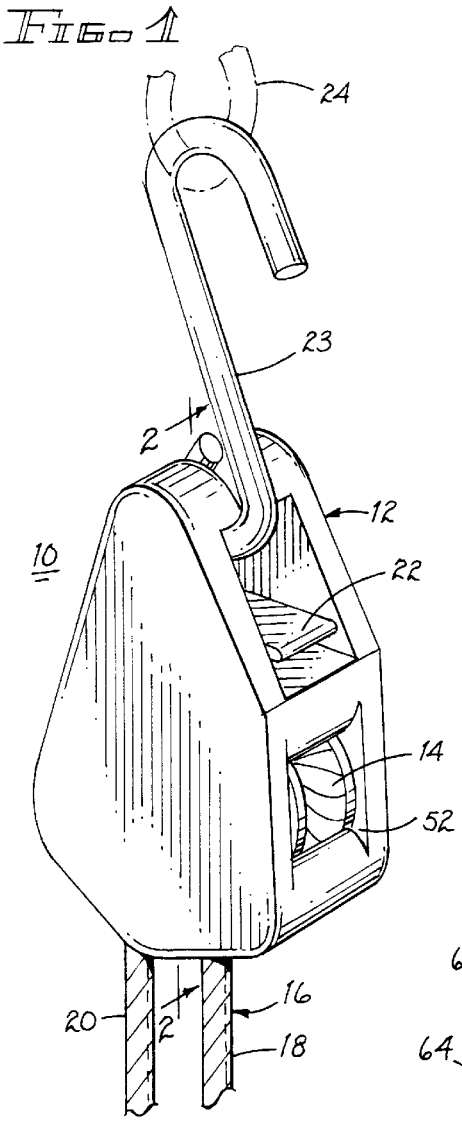
FIG. 1 is a perspective view of a ratchet.

A ratchet 10, illustrated in FIG. 1, includes a housing 12 of moldable plastic material, which material is of sufficient robustness to withstand the loads imposed. Material suitable may include nylon, delrin, or any of other known or to be developed plastic materials having high strength characteristics. A spool 14, rotatably mounted within housing 12, supports a cord 16 partially wrapped thereabout and having ends 18, 20 extending from the bottom of the ratchet. A thumb release 22 includes a pawl interferingly engaging with teeth formed as part of spool 14 to prevent rotation of the spool in one direction and yet accommodate rotation of the spool in the other direction. A hook 23 extends from the upper end of housing 12 to secure the ratchet to an anchor, or the like, as represented by ring 24. As noted from FIG. 1, the plan form of ratchet 10 is essentially tear drop shaped to provide a lateral balance from the point of suspension of the ratchet.

Figure 2:
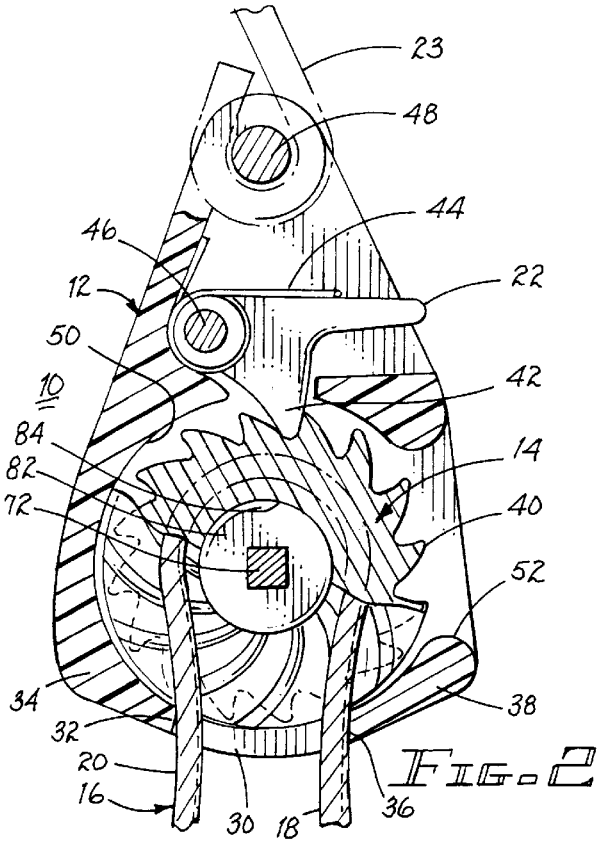
FIG. 2 is a cross-sectional view taken along lines 2—2, as shown in FIG. 1.
Figure 3:
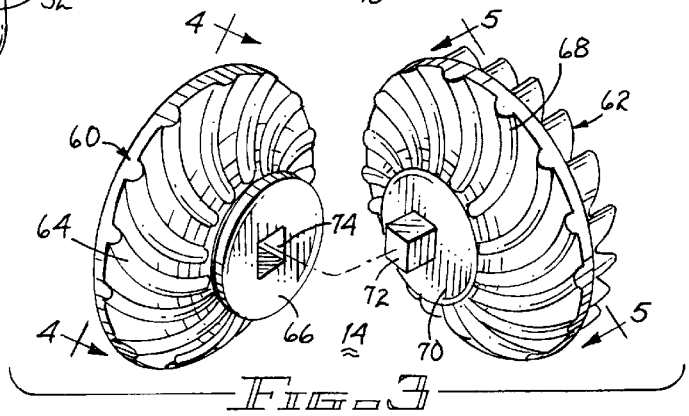
FIG. 3 is an exploded view of the spool rotatably mounted within the ratchet.

Further details attendant the structure and operation of the ratchet will be described with respect to FIG. 2. The bottom of ratchet 12 includes a slotted opening 30 defined by the terminal end 32 of end wall 34 and terminal end 36 of end wall 38. Cord 16 is partially wrapped about spool 14 with lengths 18 and 20 exiting through opening 30. Preferably, the length of opening 30, defined by terminal ends 32,36 is less than the diameter of the part of the cord looped about spool 14 to urge the cord radially inwardly about the spool upon the application of pulling forces upon lengths 18 and 20 to mechanically engage the cord with the spool and prevent slippage therebetween. The spool includes a plurality of teeth 40 selectively engagable by pawl 42 of thumb release 22 to prevent rotation of spool 14 in one direction; counter clockwise as illustrated in FIG. 2. A coil spring 44 biases pawl 42 of thumb release 22 into engagement with the teeth. Upon lifting of the thumb release, or moving it in the counter clockwise direction as shown in FIG. 2, the pawl is disengaged from teeth 40 and spool 14 is free to rotate in either direction. A pin 46, mounted within housing 12, pivotally supports thumb release 22. A rod 48, which may be formed as part of the housing 12, supports hook 23.

To secure cord 16 with ratchet 10, the terminal end of the cord is inserted through opening 30 into the left side (with reference to FIG. 2) of spool 14. Curved interior wall 50, forming in part a cavity within which the spool is housed, will guide the terminal end of the cord about the spool. Insertion of the cord will be enhanced by manually rotating the spool in the clockwise direction by manipulating the spool through opening 52 of the housing. The terminal end of the cord is brought out from within the housing through opening 30. The resulting engagement is illustrated in FIG. 2.

Figure 6:
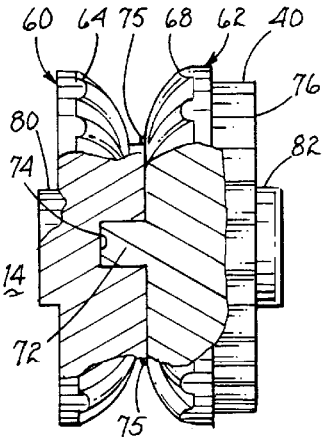
FIG. 6 is a partial cross-sectional view of the spool.
Figure 4:
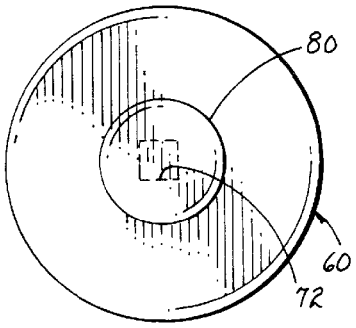
FIG. 4 is an end view taken along lines 4—4, as shown in FIG. 3.
Figure 5:
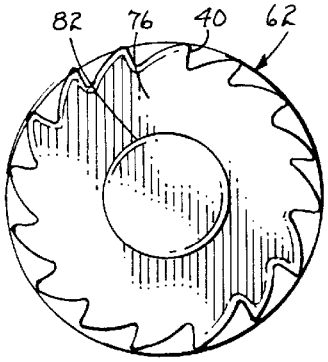
FIG. 5 is an end view taken along lines 5—5, as shown in FIG. 3.

Referring jointly to FIGS. 3 to 6, details attendant spool 14 will be described. The spool includes wheels 60, 62. Wheel 60 includes a plurality of curved ribs 64 extending outwardly from hub 66. Similar curved ribs 66 extending outwardly from hub 70 are formed in wheel 62. It is preferable that the ribs of one wheel be offset or interleaved with the ribs of the other wheel to force the cord disposed therebetween into a serpentine configuration to increase the mechanical interference between the cord and the spool and to prevent slippage therebetween without unduly squeezing the cord and causing damage to some of the strands of the cord. To ensure proper alignment between ribs 64 and 68, a key 72 extends from hub 70 for mating with a key way 74 in hub 66. The key and key way are oriented to engage one another and upon such engagement interleave ribs 64 and 68, as illustrated in FIG. 6. Hubs 66 and 70, along with key 72 and key way 74 may be sonically welded, as represented by numeral 75, to have spool 14 become a one piece unit; other attachment means, such as chemical welding, adhesive, etc. can also be used. Wheel 62 includes a disk 76 having a plurality peripherally located of teeth 40, as discussed above, forming its perimeter.

Spool 14 is rotatably mounted within housing 12 by a boss 80 extending laterally from wheel 60 and by a boss 82 extending laterally from wheel 62, which bosses serve in the manner of journals. Each of these bosses nests within corresponding circular cavities formed in housing 12. Cavity 84, for supporting boss 82, is illustrated in FIG. 2.

Figure 7:
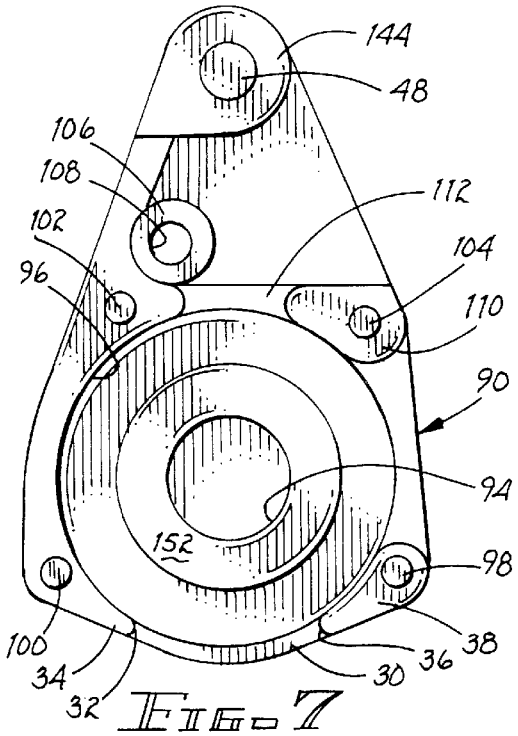
FIG. 7 is a plan view of the interior of one of the members forming the housing of the ratchet.
Figure 8:
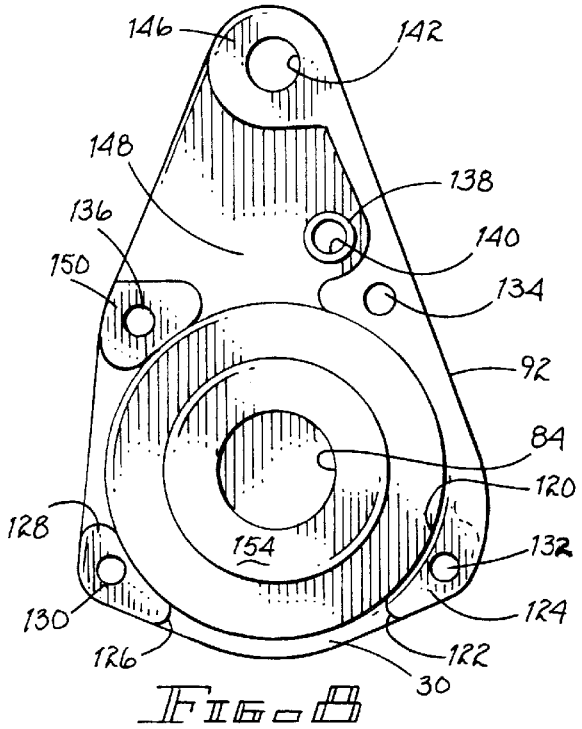
FIG. 8 is a plan view of the other member forming the housing of the ratchet.
Figure 9:
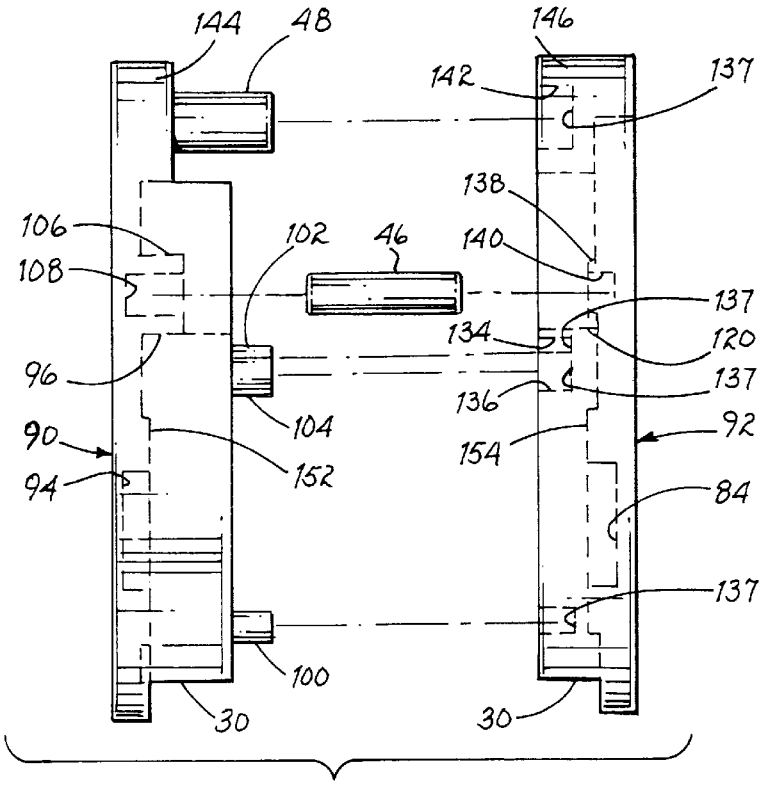
FIG. 9 is an exploded side view of the members forming the housing of the ratchet.

Referring jointly to FIGS. 7, 8 and 9, details attendant the structure of housing 12 will be described in detail. The housing is formed by a pair of members 90, 92 which are sonically welded or otherwise permanently secured to one another, as will be described in further detail below. Member 90 defines one half of opening 30 disposed between terminal ends 32, 36 of one half of end walls 34, 38. Circular cavity 94 is formed to receive boss 80 of spool 14. A further cavity represented in part by cylindrical wall 96 receives wheel 60 of spool 14. Studs 98, 100, 102, and 104 are formed as part of member 40 and extend outwardly therefrom. A further stud, which becomes rod 48, is formed as part of and extends from member 90. A boss having a cavity 108 formed therein, receives and supports one end of pin 46. Opening 52 (see FIG. 1 and FIG. 2) extends between end wall 38 and land 110 supporting stud 104. Space 112, disposed between land 110 and end wall 34, serves as an aperture or opening through which pawl 42 extends.

Member 92 includes a circular cavity 84 (see FIG. 2) for receiving boss 82 of spool 14. A cylindrical wall 120 defines in part a cavity within which wheel 62 is located. Terminal end 122 of end wall 124 and terminal end 126 of end wall 128 define, in part, opening 30. A plurality of recesses or circular cavities 130, 132, 134 and 136 are dimensioned to receive and mate with studs 98, 100, 102 and 104, respectively. Upon such mating, the end walls of opposing members 90, 92 will be adjacent one another. Permanent attachment of member 90 with member 92 can be achieved by sonically welding each of the studs with its respective cavity, as represented by numeral 137 attendant each of the stud receiving cavities. Other permanent fixation, such as chemical welding, adhesive, etc. can also be used. A boss 138, having a cavity 140 formed therein, receives and supports one end of pin 46. Cavity 142 is dimensioned to receive rod 48. As may be noted from FIGS. 7 and 8, significantly sized lands 144 and 146 are formed about the base of stud 48 and cavity 142 to ensure adequate support for the opposed ends of rod 48 and to provide the requisite degree of robustness for the intended and expected uses of ratchet 10. Space 148 between land 150 and end wall 124 serves as part of the aperture or opening through which pawl 42 of the thumb release extends. As illustrated, lands in the form of rings 152, 154 may be formed about cavities 94, 84, respectively, to provide more mass and supporting strength for the bosses of spool 14 journaled therewithin.

After assembly, it may be noted that the only parts of ratchet 10 are housing 12, spool 14, thumb release 22, coil spring 14 and hook 22. Thus, ratchet 10, compared to the known prior art, has a very small number of parts or a very low parts count. Of these parts, wheels 60, 62 members 90, 92 and thumb release 22 may be molded, which molding is relatively inexpensive. The remaining parts, pin 46 and coil spring 44, are of standard manufacture and therefore relatively inexpensive to produce. Assembly of wheels 60, 62 to form spool 14 and sonically welding or otherwise forming a permanent attachment of the wheels, is relatively inexpensive. After mounting of spool 14, thumb release 22, spring 44 and pin 46 and engaging hook 22 with rod 48, the studs extending between the members are sonically welded or otherwise permanently secured with their respective cavities, which assembly process is performable by well known techniques and is relatively inexpensive.

Figure 10:
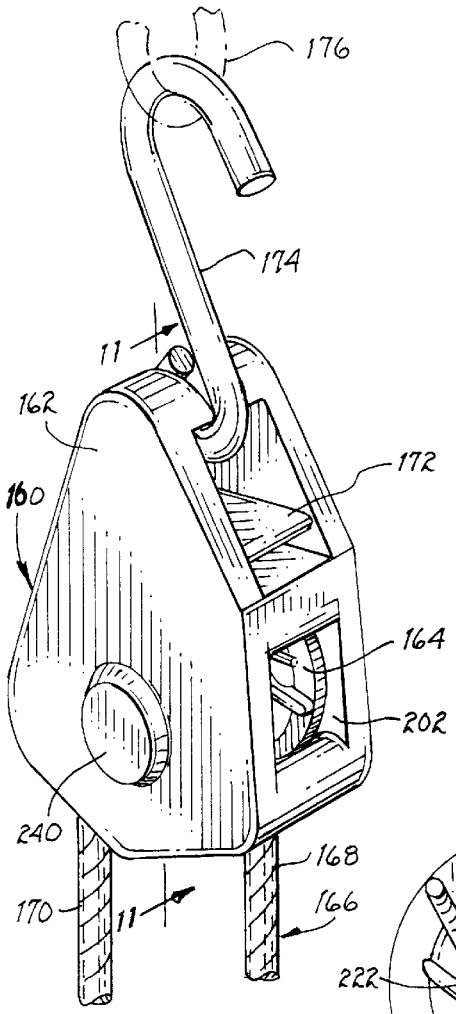
FIG. 10 is a perspective view of an improved ratchet.

A ratchet 160 having primarily a differently configured spool 164 is illustrated in FIG. 10 and includes a housing 162 of moldable plastic material, which material is of sufficient robustness to withstand the loads imposed. Materials suitable for this purpose may include nylon, delrin, or any of other known or to be developed plastic materials having high strength characteristics. Spool 164 is rotatably mounted within housing 162 and supports a cord 166 partially wrapped about the spool such that ends 168,170 of the cord extend from the bottom of the ratchet. A thumb release 172 includes a pawl interferringly engaging with teeth formed as part of one side of spool 164 to prevent rotation of the spool in one direction and yet accommodate rotation of the spool in the other direction. A hook 174 extends from the upper end of housing 162 to secure the ratchet to an anchor, such as represented by element 176.

Figure 11:
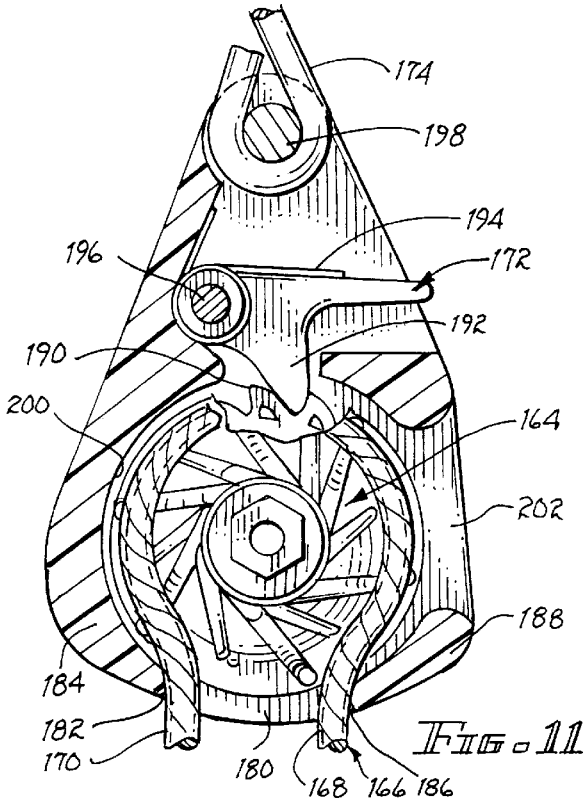
FIG. 11 is a cross-sectional view taken along lines 11—11, as shown in FIG. 10.
Figure 13:
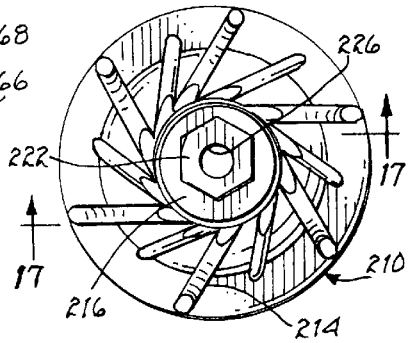
FIG. 13 is a view of one of the spool wheels taken along lines 13—13, as shown in FIG. 12.
Figure 14:
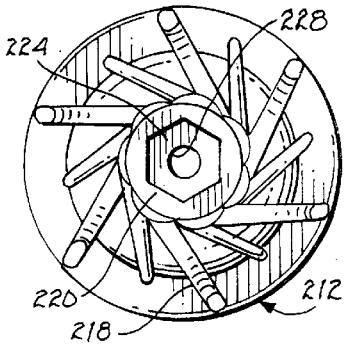
FIG. 14 is a view of another of the spool wheels taken along lines 14—14, as shown in FIG. 12.

Further details attendant the structure and operation of ratchet 160 will be described with respect to FIG. 11. The bottom of the ratchet includes a slotted opening 180 defined by terminal end 182 of end wall 184 and terminal end 186 of end wall 188. Cord 166 is partially wrapped about spool 164 with ends 168 and 170 exiting through opening 180. Preferably, the length of the opening is less than the diameter of the cord loop extending about spool 164 to urge the cord radially inwardly within the spool upon the application of pulling forces upon ends 168 and 170 to mechanically engage the cord with the spool and prevent slippage therebetween. The spool includes a plurality of teeth 190 selectively engageable by pawl 192 of thumb release 172 to prevent rotation of spool 164 in one direction; counterclockwise as shown in FIG. 11. A coil spring 194 biases pawl 192 into engagement with teeth 190. Upon lifting of the thumb release, or moving it in the counterclockwise direction (as viewed in FIG. 11), the pawl is disengaged from teeth 190 and spool 164 is free to rotate in either direction. A pin 196, mounted within housing 162, pivotally supports the thumb release. A rod 198, which may be a separate shaft or formed as part of housing 162, supports hook 174.

To secure cord 166 within ratchet 160, the terminal end of the cord is inserted through opening 180 into the left side (referring to FIG. 11) of spool 164. Curved interior wall 200, forming a part of a cavity within which the spool is housed, will guide the terminal end of the cord about the spool. Insertion of the cord will be enhanced by manually rotating the spool in the clockwise direction by manipulating the spool through opening 202 of the housing. The terminal end of the cord is brought out from within the housing through opening 180.

Figure 12:
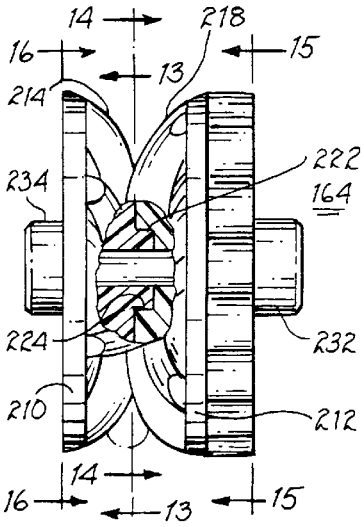
FIG. 12 is a front elevational view of a spool.
Figure 15:
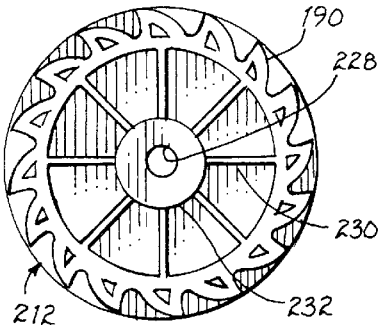
FIG. 15 is a side view of the spool taken along lines 15—15, as shown in FIG. 12.
Figure 16:
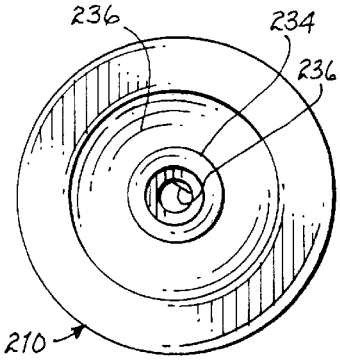
FIG. 16 is a side view of the spool taken along lines 16—16, as shown in FIG. 12.
Figure 19:
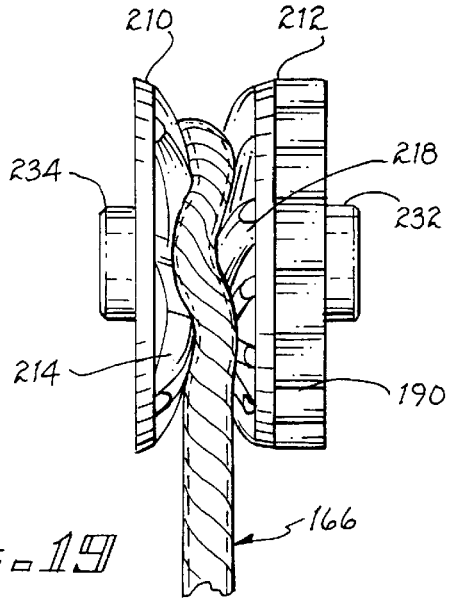
FIG. 19 illustrates the serpentine configuration of a cord wrapped about the spool.

Referring jointly to FIGS. 12, 13, 14, 15, and 16, details attendant spool 164 will be described. The spool includes wheels 210 and 212. Wheel 210 includes a plurality of ribs 214 extending outwardly from hub 216. Similar ribs 218 extend outwardly from hub 220 in wheel 212. Ribs 214,218 may be rectilinear, as illustrated, or curved; in either event, an imaginary extension or projection of the interior end of either type of rib would not extend through the axes of rotation, or the center, of the respective wheel; that is, none of the ribs nor any portion thereof are radial to the axis of rotation of the spool. Upon assembly of wheels 210,212 with one another, it is preferable that the ribs of one wheel be offset or interleaved with the ribs of the other wheel to force the cord disposed therebetween into a serpentine configuration (note FIG. 19) to increase the mechanical interference between the cord and the spool and to prevent slippage therebetween without unduly squeezing the cord and causing damage to some of the strands of the cord. To ensure proper alignment of the wheels about their common axes of rotation to interleave the ribs, a key 222 extends from hub 216 of wheel 210 and a mating keyway 224 for receiving key 22 is disposed in hub 220 of wheel 212. As illustrated, key 222 is hexagonal in cross-section and keyway 224 is a hexagonal cavity. Passageway 226 extending through the center of wheel 10 is formed primarily for molding purposes to reduce the amount of material forming the hub to minimize shrinkage upon cooling of the material; similarly, passageway 228 extends through the center of wheel 212 for the same purpose. After mating of key 222 with keyway 224, the respective ribs of wheels 210 and 212 will be in opposed interleaved relationship, as illustrated in FIG. 12. The two wheels may be permanently secured to one another by sonic welding, chemical welding, by use of adhesives, or other assembly procedures well known to plastic fabricators. After such attachment, the two wheels form or become a one piece unit that is not intended to be disassemblable. Wheel 212 includes a disk-like element having a plurality of teeth 190 disposed at its perimeter and a plurality of radially aligned spokes 230 extending from a boss 232 to support the peripherally located teeth.

Spool 164 is rotatably mounted within housing 162 by a boss 232 extending laterally from wheel 212 and by a boss 234 extending from wheel 210. These bosses are concentric with the axis of rotation of the spool and serve in the manner of journals for supporting wheel 164. As noted in FIG. 16, a shallow circular indentation 236 may be formed in the outer side of wheel 210 radially outwardly of boss 234 to reduce the amount of plastic material and thereby reduce shrinkage during manufacture. For similar reason, passageways 226 and 228 extend through the bosses to help maintain the dimensional integrity of the bosses upon cooling of the plastic material of which the wheels are made. Each of bosses 232,234 nest within corresponding circular cavities formed in housing 162. To provide sufficient depth for such cavities without the use of excessive material in the sides of housing 162, a protrusion 240 may be formed on opposed sides of the housing (note FIG. 1) to accommodate the depth of the boss receiving cavity and simultaneously minimize the quantity of plastic necessary to provide sufficient structural support.

Figure 18:
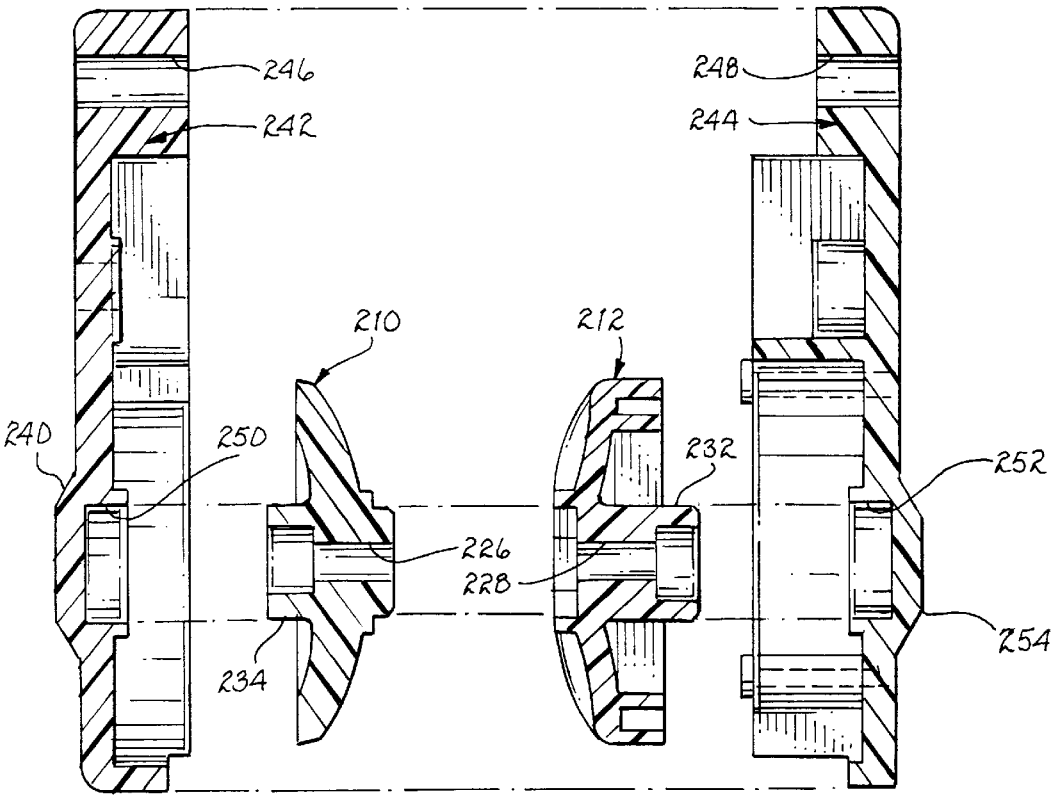
FIG. 18 is an exploded cross-sectional view illustrating the pair of members forming the housing and the two wheels of the spool.
Figure 17:
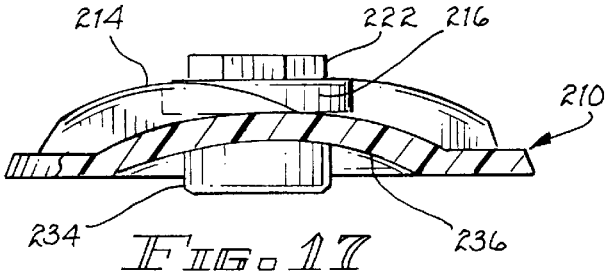
FIG. 17 is a view taken along broken line 17—17, as shown in FIG. 13.

Referring to FIG. 18, details attendant the structure of housing 162 and its support for spool 164 will be described in detail. The housing is formed by a pair of members 242,244 which are sonically welded or otherwise permanently secured to one another. In the following description, reference may be made to FIGS. 7 and 8 with respect to common structural components. Member 242 defines one-half of housing 162 and member 244 defines the other half. Each of the members includes a portion of the various side walls necessary to define the space therebetween and the cavities for spool 164 and pawl 192. Rod 198 (see FIG. 11) may be lodged within cavities 246,248 at the upper end of the members or the rod may be formed as an integral part of one member and extending into a corresponding cavity of the other member upon assembly.

Member 242 includes a circular depression 250 for rotatably receiving boss 234 of wheel 210. A protrusion 240 may be formed in the member to accommodate the depth of the depression without compromising the support strength of the depression while minimizing the amount of material in the corresponding wall of the member. Similarly, member 244 includes a circular depression 252 for rotatably receiving boss 232 of wheel 212. A protrusion 254 is formed in the member to accommodate the depth of the depression without compromising the structural support provided while minimizing the amount of plastic material necessary for the corresponding wall of member 244. As noted in FIG. 18, passageway 226 may be stepped to a larger diameter in correspondence with boss 234 to reduce the amount of plastic of the wheel and hence reduce shrinkage of the boss during curing. Similarly, passageway 228 of wheel 212 may be stepped to provide a larger diameter passageway corresponding with boss 232 to reduce the material of the boss and minimize shrinkage of the boss during curing of the plastic.

With the low parts count, the likelihood of failure of any given part and hence failure of the ratchet is significantly reduced. The permanent nature of the assembly process prevents a user from disassembling the ratchet or removing any part thereof without destroying the ratchet. Such impediment to disassembly or modification increases and enhances the useful life of the ratchet. Should a failure occur, the ratchet should be discarded without an attempt of repair to ensure that failure resulting in potentially catastrophic results does not occur.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A ratchet, said ratchet comprising in combination:

(a) a housing for supporting a cord engageable spool and including a thumb release for selectively limiting rotation of said spool in one direction and for releasing said spool to rotate in either direction;

(b) said spool having an axis of rotation and comprising a first wheel and a second wheel, a key and a keyway formed as integral parts of said first and second wheels, respectively, for securing said first and second wheels with one another to prevent relative rotation therebetween, a plurality of first ribs formed on a surface of said first wheel in opposed and interleaved relationship with a plurality of second ribs formed on a surface of said second wheel to grip the cord, each of said first and second ribs including an inner end and in outer end, a first boss formed as part of and extending laterally from said first wheel along the axis of rotation of said spool and a second boss formed as part of and extending laterally from said second wheel along the axis of rotation of said spool; and (c) a first cavity and a second cavity disposed in said housing in opposed relationship for rotatably receiving and supporting said first and second bosses to rotatably support said spool within said housing, each of said first and second cavities including a cylindrical wall and an end surface extending across said cylindrical wall, said housing including laterally oriented first and second protrusions for compensating for the depth of said first and second cavities, respectively, in said housing.

2. The ratchet as set forth in claim 1 wherein said first wheel includes a first hub and wherein the inner end of each rib of said first plurality of ribs terminates at said first hub and wherein said second wheel includes a second hub and wherein the inner end of each rib of said second plurality of ribs terminates at said second hub.

3. The ratchet as set forth in claim 1 wherein each rib of said first and second plurality of ribs is configured such that an imaginary interiorly oriented projection of each rib of said first and second plurality of ribs would not intersect the axis of rotation of said spool.

4. The ratchet as set forth in claim 1 wherein each rib of said first and second plurality of ribs is non-radially oriented.

5. The ratchet as set forth in claim 1 wherein each rib of said first and second plurality of ribs is a non-radial rectilinear rib.

6. The ratchet as set forth in claim 1 wherein each of said housing and said spool is formed of plastic material.

7. The ratchet as set forth in claim 1 wherein said spool is journalled within said housing solely by said first and second bosses disposed within said first and second cavities, respectively.

8. A ratchet, said ratchet comprising in combination:

(a) a housing for supporting a cord engageable spool and including a thumb release for selectively limiting rotation of said spool in one direction and for releasing said spool to rotate in either direction;

(b) said spool having an axis of rotation comprising in combination a pair of wheels interconnected with one another to prevent relative rotation therebetween, a pair of bosses extending from opposed sides of said spool and centered along the axis of rotation for rotatably supporting said spool; and (c) a pair of opposed cavities disposed within said housing and enabled to rotatably engage said bosses to rotatably support said spool within said housing, each cavity of said pair of cavities including a circular wall and an end surface extending across said circular wall.

9. The ratchet as set forth in claim 8 including a first and second plurality of rectilinear ribs formed as part of said first and second wheels, respectively, to engage from opposed sides a cord partially extending about said spool.

10. The ratchet as set forth in claim 9 wherein each rib of said first and second plurality of ribs is non-radial with respect to the axis of rotation of said spool.

11. The ratchet as set forth in claim 8 wherein said housing, said spool and said bosses for rotatably supporting said spool within said housing are of plastic material.

12. The ratchet as set forth in claim 8 wherein said spool includes a passageway extending therethrough along the axis of rotation to reduce an amount of plastic material and minimize shrinkage upon curing of the plastic material.

13. The ratchet as set forth in claim 12 wherein said passageway is a dual stepped passageway.

14. The ratchet as set forth in claim 13 including a key circumscribing said passageway in said first wheel and a keyway circumscribing said passageway in said second wheel for mating with said key.

15. The ratchet as set forth in claim 8 including a key and a mating keyway for joining said first and second wheels with one another to preclude relative rotation therebetween.

16. A ratchet as set forth in claim 8 including first and second protrusions extending laterally from said housing in generally alignment with the axis of rotation of said spool and generally coincident with said first and second cavities, respectively.

17. A ratchet, said ratchet comprising in combination:

(a) a housing for supporting a cord engageable spool and including a thumb release for selectively limiting rotation of said spool in one direction and for releasing said spool to rotate in either direction;

(b) said spool having an axis of rotation comprising in combination a pair of wheels interconnected with one another to prevent relative rotation therebetween;

(c) a first and second plurality of ribs formed as part of said first and second wheels, respectively, adapted to engage from opposed sides a cord partially extending about said spool;

d) a pair of bosses extending from opposed sides of said spool and centered along the axis of rotation for rotatably supporting said spool; and (e) a pair of opposed cavities disposed within said housing and enabled to rotatably engage said bosses to rotatably support said spool within said housing, each cavity of said pair of cavities including a circular wall and an end surface extending across said circular wall and a pair of laterally extending protrusions disposed upon said housing generally coincident with said first and second cavities, respectively, for compensating for the reduced material of said housing attendant said first and second cavities.

18. The ratchet as set forth in claim 17 wherein each said circular wall is a cylindrical wall.

* * * * *